United States Patent [19]

Bro et al.

[11] Patent Number: 4,772,241

[45] Date of Patent: Sep. 20, 1988

[54] TOY TOP WITH IMPELLER-DRIVEN FLYWHEEL

[75] Inventors: Jay M. Bro, Long Beach; Raymond R. Lynch, Anaheim; Peter C. Hill, Hermosa Beach; Arthur J. Foss, Torrance; Richard G. Garza, Norwalk; Gary M. Saffer, Rancho Palos Verdes; Wayne R. Halford, Manhattan Beach, all of Calif.

[73] Assignee: Mattel, Inc., Hawthorne, Calif.

[21] Appl. No.: 76,522

[22] Filed: Jul. 22, 1987

[51] Int. Cl.[4] ..... A63H 33/40; A63H 1/20; A63H 1/08; A63H 13/20

[52] U.S. Cl. ..... 446/202; 446/263; 446/234; 272/31 R

[58] Field of Search ..... 446/254, 263, 199, 201, 446/202, 204, 217, 233, 234, 236, 256, 257, 262, 264, 401, 405, 4, 330; 272/31 R, 31 A, 46

[56] References Cited

U.S. PATENT DOCUMENTS

| | | | |
|---|---|---|---|
| 1,033,671 | 7/1912 | Campbell | 446/262 X |
| 1,281,866 | 10/1918 | Stahl | 446/264 |
| 1,401,952 | 1/1922 | Asaturian | 446/263 |
| 1,783,627 | 12/1930 | Raimondi | 446/256 |
| 2,753,656 | 7/1956 | Bertsch | 446/201 |
| 2,839,869 | 6/1958 | Lopez | 446/257 X |
| 2,906,057 | 9/1959 | Sullivan | 446/262 X |
| 3,680,252 | 8/1972 | Feltman | 446/199 |
| 3,876,205 | 4/1975 | Drohomirecky | 446/256 X |
| 4,211,030 | 7/1980 | Morrison et al. | 272/31 R X |
| 4,538,999 | 9/1985 | Orlowski | 446/263 X |

FOREIGN PATENT DOCUMENTS

| | | | |
|---|---|---|---|
| 0077438 | 4/1983 | European Pat. Off. | 446/204 |
| 867387 | 9/1981 | U.S.S.R. | 446/236 |
| 12917 | of 1896 | United Kingdom | 446/202 |
| 656951 | 9/1951 | United Kingdom | 446/223 |
| 13671 | 10/1984 | United Kingdom | 446/234 |

*Primary Examiner*—Robert A. Hafer
*Assistant Examiner*—D. Neal Muir
*Attorney, Agent, or Firm*—Ronald M. Goldman; Melvin A. Klein

[57] ABSTRACT

A toy top having an air impeller-driven flywheel and a spring-latch mechanism which releases an upper portion of the top from a lower housing when an articulated arm of the spinning top comes into contact with an object such as a stationary object or another top. The flywheel located inside the lower housing is rotated by blowing air into one of two ducts on the housing. The stream of air comes into contact with the blades of an impeller causing rotation of the impeller and the flywheel which is attached to the impeller. The flywheel is attached to a shaft rotatably mounted inside the housing. Slots in bosses extending upward from the housing releasably engage a plate at the bottom of the upper portion. The slots disengage from the plate when one of two articulated arms of the spinning top contacts an object allowing a spring mounted inside the upper portion to push the upper portion away from the lower housing. The top appears to "blow up" as the upper portion pops up from the housing.

6 Claims, 2 Drawing Sheets

FIG. 5.
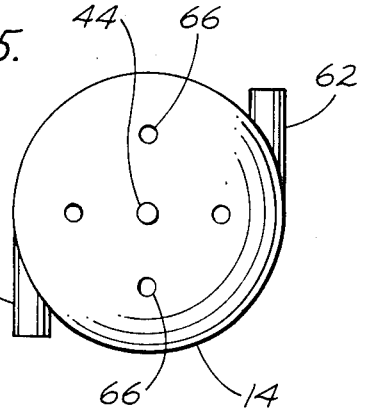
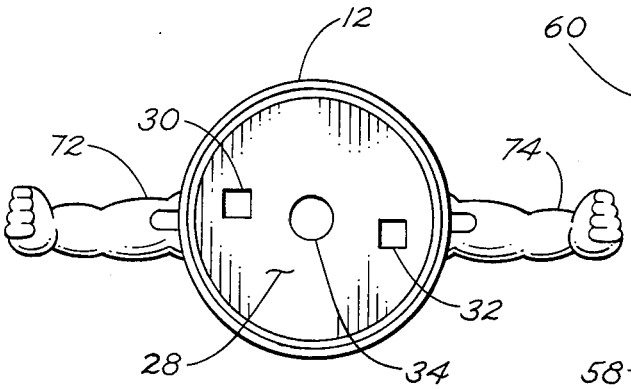
FIG. 6.
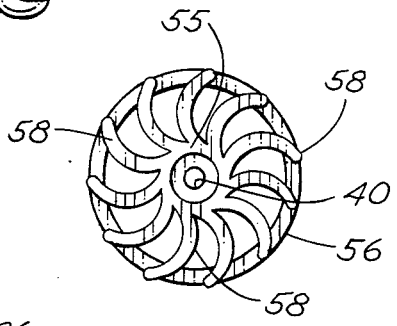
FIG. 8.
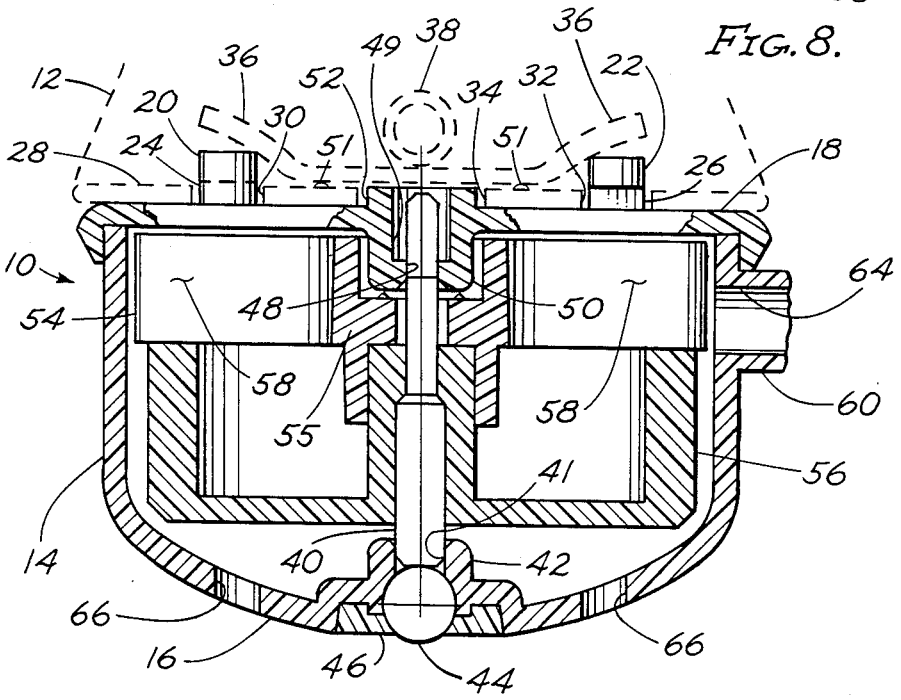
FIG. 7.

TOY TOP WITH IMPELLER-DRIVEN FLYWHEEL

BACKGROUND OF THE INVENTION

The present invention relates generally to gyroscopic tops and, more particularly, to a toy top with an air impeller-driven flywheel and a spring-latch mechanism which releases an upper portion of the top when an articulated appendage of the spinning top comes into contact with an object.

In the past, different toy gyroscopic tops have been designed such as those disclosed in U.S. Pat. Nos. 99,644 to Coombs on Feb. 8, 1870; 2,148,374 issued to Hogan on Feb. 21, 1939; and 2,736,132 issued to Murray on Feb. 28, 1956. Other gyroscopic toys are shown in U.S. Pat. Nos. 944,096 issued to Kirby on Dec. 21, 1909; 1,821,940 issued to Hinsen on Sept. 8, 1931; Re. 30,299 reissued to Greenwood on June 10, 1980; 4,400,908 issued to Nomura on Aug. 30, 1983; and 4,556,396 issued to Kennedy et al on Dec. 3, 1985. Tops using air impellors are described in U.S. Pat. Nos. 620,151 issued to Kjellen on Feb. 28, 1899; 1,629,135 issued to Vinson on May 17, 1927; and 3,372,511 issued to Smith et al on Mar. 12, 1968. A top using lips around the circumference thereof to inflate a figure mounted on the top is shown in U.S. Pat. No. 1,278,208 issued to Pruitt on Sept. 10, 1918.

U.S. Pat. No. 4,538,999 issued to Orlowski on Sept. 3, 1985 discloses a top having a cover which is ejected when the spinning top slows down or centrifugal force is decreased. A pop-up figure is used for the top shown in U.S. Pat. No. 1,281,866 issued to Stahl on Oct. 15, 1918. Figure toys having parts that pop-up or eject therefrom are disclosed in U.S. Pat. Nos. 1,277,702 issued to Combes on Sept. 3, 1918; 3,235,259 issued to Glass et al on Feb. 15, 1966; 4,118,888 to Ogawa on Oct. 10, 1978; and 4,125,961 issued to Yamashina on Nov. 21, 1978. Toy hand grenades or detonating devices are shown in U.S. Pat. Nos. 1,367,391 issued to Hofer on Feb. 1, 1921; 1,536,261 issued to Eames on May 5, 1925; 2,897,630 issued to Horowitz et al on Aug. 4, 1959; 3,029,556 issued to Ayala on Apr. 17, 1962; 3,139,697 issued to Mier on July 7, 1964; 3,304,650 issued to Glass et al on Feb. 21, 1967; 3,564,756 issued to Yokoi on Feb. 23, 1971; 3,878,639 issued to Scheelar et al on Apr. 22, 1975; and 4,319,426 issued to Lee on Mar. 16, 1982.

Other toys having parts which are ejected therefrom are described in U.S. Pat. Nos. 1,300,177 issued to Kohn on Apr. 8, 1919; 1,859,100 to Lewis on May 17, 1932; 2,052,841 issued to O'Donnell on Sept. 1, 1936; 3,687,452 issued to Thompson on Aug. 29, 1972; 3,734,500 issued to Cooper on May 22, 1973; and 4,571,197 issued to Kulesza et al on Feb. 18, 1986. Finally, U.S. Pat. No. 4,623,318 issued to Tsiknopoulos et al on Nov. 18, 1986 shows a figure toy having an upper torso which rotates causing a pair of arms to move upward due to centrifugal force.

None of the above patents discloses a toy top having an air impeller-driven flywheel and a spring-latch mechanism which releases an upper portion of the top when an articulated appendage of the spinning top comes into contact with an object. Accordingly, there is a need in the toy manufacturing arts for such a toy top.

SUMMARY OF THE INVENTION

It is an object of this invention to provide a toy top having a flywheel which may be rotated by blowing air against an impeller attached to the flywheel.

It is another object of this invention to provide a toy top having an air impeller-driven flywheel mounted in a lower housing and a spring-latch mechanism which releasably mounts an upper portion of the top onto the lower housing and which releases the upper portion when an articulated appendage of the spinning top comes into contact with an object such as a stationary object or another top.

These and other objects and advantages are attained by a toy top having an impeller-driven flywheel and a spring-latch mechanism which releases an upper portion of the top from a lower housing when an articulated arm of the spinning top comes into contact with an object such as a stationary object or another top. The flywheel located inside the lower housing is rotated by blowing air into one of two ducts on the housing. The stream of air comes into contact with the blades of an impeller causing rotation of the impeller and the flywheel which is attached to the impeller. The flywheel is attached to a shaft rotatatly mounted inside the housing. Slots in bosses extending upward from the housing releasably engage a plate at the bottom of the upper portion. The slots disengage from the plate when one of two articulated arms of the spinning top contacts an object allowing a spring mounted inside the upper portion to push the upper portion away from the lower housing. The top appears to "blow up" as the upper portion pops up from the housing.

The various features of the present invention will be best understood together with further objects and advantages by reference to the following description of the preferred embodiment taken in connection with the accompanying drawings.

BRIEF DESCRIPTION OF THE DRAWINGS

FIG. 5 is a bottom plan view of the lower housing;

FIG. 6 is a bottom plan view of the upper portion showing the arms rotated upward;

FIG. 7 is a partial cross-sectional view taken in the direction of arrows 7—7 shown in FIG. 4; and FIG. 8 is a top plan view of an air-impeller and flywheel which are mounted in the lower housing.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment although it should be understood that various modifications can be accomplished within the parameters of the present invention.

Figure 1:
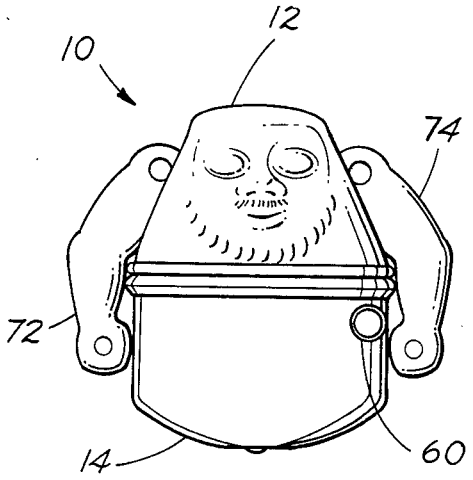
FIG. 1 is a front elevational view of a toy top of the present invention.
Figure 2:
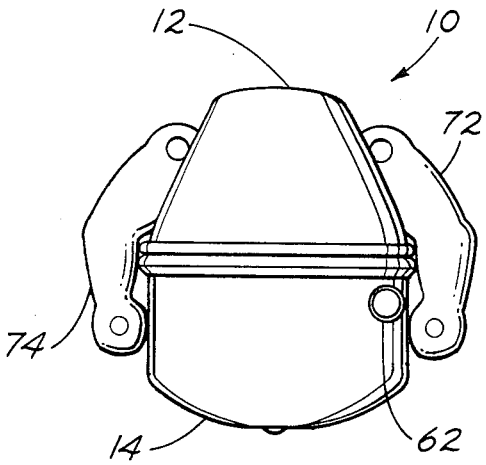
FIG. 2 is a rear elevational view of the toy top of FIG. 1.
Figure 3:
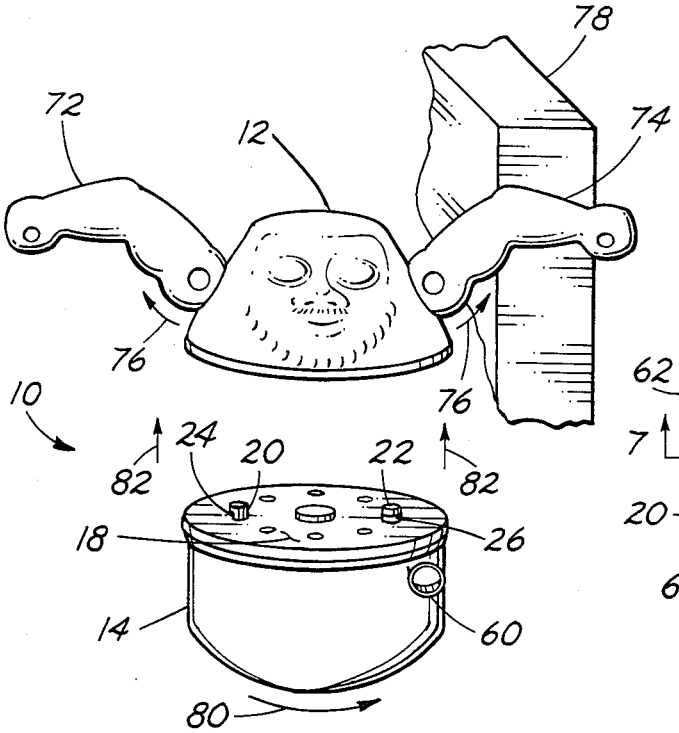
FIG. 3 is a perspective view of the toy top of FIG. 1 showing how an upper portion is released from a lower housing when one of the arms of the spinning top comes into contact with an object.

Referring now to the drawings and particularly to FIGS. 1, 2 and 7, a preferred embodiment of the toy top 10 of the present invention is disclosed. The toy top 10 has an upper portion 12 and lower housing 14 which may be releasably coupled together as explained in the following discussion. The lower housing 14 is generally cylindrically-shaped as shown in FIG. 7 having a curved bottom portion 16 and a generally flat plate 18 attached at its top end. The wall thickness of the housing 14 may be varied as desired. Bosses 20 and 22 extend upward from plate 18 and have slots 24 and 26, respectively, as shown in FIGS. 3 and 7. The upper portion 12 is preferably hollow having a generally flat plate 28 attached at its bottom end (see FIGS. 6 and 7). Plate 28 has apertures 30, 32 and 34 therein. A spring 36 is mounted inside the upper portion 12 as shown in FIG. 7. The spring 36 may be mounted in any manner such as between socket 38 and protuberances 51 as shown in FIG. 7. Also, more than one spring may be used if desired.

A shaft 40 is rotatably mounted inside the lower housing 14 as shown in FIG. 7. The lower end of the shaft 40 rotatably engages aperture 41 in portion 42 of the housing 14 and rests on top of a ball bearing 44 trapped between portion 42 and insert 46 press fit at the bottom of the housing. Shaft 40 rotatably engages aperture 48 in downwardly extending portion 50 of plate 18 as shown in FIG. 7. The top end of the shaft 40 extends into aperture 49 in portion 50 and upwardly extending portion 52 of plate 18. A flywheel 56 is press fit to the shaft 40 and rotates with the shaft. An air impeller 54 is press fit to the flywheel 56. As such, the shaft 40, air impeller 54 and flywheel 56 rotate together. In alternative embodiments, the air impeller 54 may be press fit to the shaft 40, or the impeller 54, flywheel 56 and shaft 40 may be formed as an integral piece. The air impeller 54 has a plurality of blades 58 attached to hub 55 as shown in FIG. 8. As an alternate embodiment (not shown) of the toy top 10, the shaft 40 may be mounted inside the lower housing 14 so that it will not rotate and the air impeller 54 and flywheel 56 may be rotatably coupled to the shaft.

Figure 4:
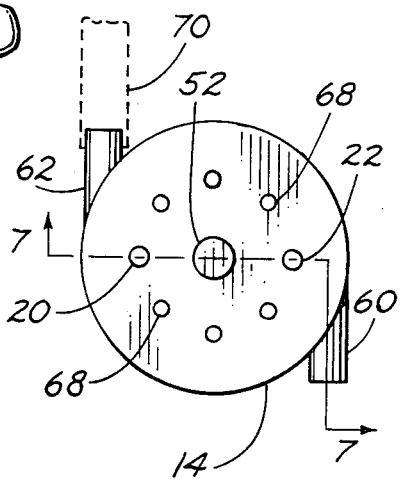
FIG. 4 is a top plan view of the lower housing showing how a tube represented by dashed lines can be used with one of the air ducts of the housing.

The lower housing 14 has two air ducts 60 and 62 as shown in FIGS. 1, 2, 4 and 5. The ducts 60 and 62 are generally cylindrically-shaped having an inside diameter 64 (see FIG. 7). A child may rotate the flywheel 56 by blowing or forcing air through one of the ducts 60 and 62 against blades 58 (see FIG. 8) of the impeller 54. The stream of air forced through one of the ducts 60 and 62 against blades 58 causes impeller 54 and shaft 40 to rotate inside the lower housing 14. Flywheel 56 rotates with shaft 40. The air forced into the lower housing 14 through one of the ducts 60 and 62 passes out of the housing through the other duct, apertures 66 at the bottom of the housing (see FIG. 7) and apertures 68 in plate 18 (see FIG. 4). A child may blow air into one of the ducts 60 and 62 by placing the duct between his or her lips and blowing into it, attaching a tube 70 to the duct as shown in FIG. 4 and blowing into the tube, or by using some sort of air pump. The toy top 10 functions like a gyroscopic top after the flywheel 56 is rotated by blowing air through one of the ducts 60 and 62.

The upper portion 12 may be releasably coupled to the lower housing 14 as follows. First, bosses 20 and 22 and portion 52 are inserted into apertures 30, 32 and 34, respectively. Note that bosses 20 and 22 bend the ends of spring 36 upward as shown in FIG. 7. Then, portion 12 and housing 14 are rotated about a vertical axis with respect to each other until slots 24 and 26 of bosses 20 and 22 engage plate 28 holding the two parts of the toy top 10 together. The upper portion 12 and lower housing 14 may be uncoupled by rotating the two parts with respect to each other until slots 24 and 26 disengage plate 28 and spring 36 pushes bosses 20 and 22 out of apertures 30 and 32. Note that slots 24 and 26 are orientated with respect to ducts 60 and 62 so that the lower housing 14 must be rotated opposite to the direction of rotation of the flywheel 56 in order to engage the slots to plate 28. Conversely, housing 14 must be rotated in the direction of the flywheel 56 to disengage slots 24 and 26 from plate 28.

After the upper portion 12 is coupled to the lower housing 14 and the flywheel 56 is rotated by blowing air through one of the ducts 60 and 62, the toy top 10 will spin like a gyroscopic top on a supporting surface with the ball bearing 44 in contact with the surface. As the top 10 spins about bearing 44, two arms 72 and 74 rotatably coupled to the upper portion 12 rotate upward in the direction of arrows 76 shown in FIG. 3 due to centrifugal force. Conversely, the arms 72 and 74 will rotate downward as the top 10 slows down. The arms 72 and 74 rotate about a horizontal axis. However, other tpes of articulated arms or appendages which rotate due to centrifugal force may be used. For example, arms that rotate about a vertical axis may be used (not shown). Also, appendages may be rotatably coupled to the lower housing 14 if desired (not shown). Any type of articulated appendage may be used that rotates outward from the housing when the top spins.

The bosses 20 and 22 with slots 24 and 26, spring 36 and plate 28 with apertures 30 and 32 function like a spring-latch mechanism which may be used to release the upper portion 12 from the lower housing 14 when one of the arms 72 and 74 of the spinning top 10 comes into contact with an object 78 (see FIG. 3) such as a stationary object or another top. When the top 10 is spinning in the direction of arrow 80 and one of arms 72 and 74 comes into contact with object 78 as shown in FIG. 3, object 78 prevents the upper portion 12 from spinning while the lower housing 14 continues to spin in the direction of arrow 80 due to its own momentum and the gyroscopic effect of flywheel 56. The continued rotation of housing 14 causes slots 24 and 26 to disengage from plate 28 and spring 36 to force bosses 20 and 22 out of apertures 30 and 32 and portion 52 out of aperture 34. As a result, upper portion 12 moves upward in the direction of arrows 82 shown in FIG. 3 or is released or separated from housing 14 as spring 36 forces or pushes the two parts of the top 10 apart. The toy top 10 appears to "blow up" as portion 12 pops up from housing 14.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy top comprising:

a lower housing having at least one air duct;

a shaft rotatably mounted inside said lower housing;

a flywheel attached to said shaft;

air impeller means mounted inside said lower housing for rotating said flywheel in response to air being blown through one of said air ducts;

an upper portion releasably coupled to said lower housing, said upper portion having at least one articulated appendage rotatably coupled thereto; and spring-latch means for releasably coupling said upper portion to said lower housing so that said upper portion moves upward and away from said housing in response to one of said articulated appendages contacting an object while said toy top is spinning.

2. The toy top of claim 1 wherein said spring-latch means includes (a) two bosses having slots therein attached to the top of said housing and capable of releasably engaging appertures in said upper portion and (b) spring means mounted inside said upper portion for forcing said bosses out of said appertures and said upper portion upward and away from said housing, said slots of said bosses capable of releasably engaging said upper portion when said upper portion is rotated with respect to said housing.

3. The toy top of claim 2 wherein said impeller means includes a plurality of blades attached to a hub.

4. The toy top of claim 3 further comprising a ball bearing mounted at the bottom of said lower housing so that said toy top spins on said bearing.

5. A toy top comprising:

a lower housing having at least one air duct;

a shaft mounted inside said lower housing;

a flywheel rotatably mounted to said shaft;

air impeller means mounted inside said lower housing for rotating said flywheel in response to air being blown through one of said air ducts;

an upper portion releasably coupled to said lower housing, said upper portion having at least one articulated appendage rotatably coupled thereto; and spring-latch means for releasably coupling said upper portion to said lower housing so that said upper portion moves upward and away from said housing in response to one of said articulated appendages contacting an object while said toy top is spinning.

6. A toy top comprising:

a lower housing having at least one air duct and two bosses extending upward from the top thereof, each of said bosses having a slot therein;

a shaft rotatably mounted inside said lower housing;

a flywheel attached to said shaft;

air impeller means mounted inside said lower housing and attached to said flywheel for rotating said flywheel in response to air being blown through one of said air ducts;

an upper portion releasably coupled to said lower housing, said upper portion having at least one articulated appendage rotatably coupled thereto and a plate with apertures therein at the bottom thereof, said bosses capable of releasably engaging said apertures, said slots capable of releasably engaging said plate when said upper portion is rotated with respect to said housing; and spring means mounted inside said upper portion for forcing said bosses out of said apertures and said upper portion upward and away from said housing in response to one of said articulated appendages contacting an object while said toy top is spinning.

* * * * *